US006666757B1

(12) United States Patent
Kim

(10) Patent No.: US 6,666,757 B1
(45) Date of Patent: Dec. 23, 2003

(54) CENTRIFUGAL BARREL FINISHING MACHINE

(76) Inventor: Jem Ma Kim, Suit 102-711, Doosan apartment, Gaebong-dong 472, Kuro-ku, Seoul (KR)

( * ) Notice: Subject to any disclaimer, the term of this patent is extended or adjusted under 35 U.S.C. 154(b) by 0 days.

(21) Appl. No.: 10/192,065

(22) Filed: Jul. 10, 2002

(51) Int. Cl.[7] ..... B24B 31/33
(52) U.S. Cl. ..... 451/327; 451/329; 451/32
(58) Field of Search ..... 451/326–330, 451/32

(56) References Cited

U.S. PATENT DOCUMENTS 3,078,623 A * 2/1963 Stantley ..... 451/32
3,512,604 A * 5/1970 Matsunaga et al. ..... 180/127
4,104,831 A 8/1978 Kobayashi
4,505,072 A 3/1985 Kobayashi et al.
5,454,749 A * 10/1995 Ohno ..... 451/329
5,531,637 A * 7/1996 Kimura ..... 451/329
5,672,094 A * 9/1997 Nishimura et al. ..... 451/32
5,733,172 A 3/1998 Nishimura et al.
6,350,189 B1 * 2/2002 Tanaka ..... 451/326

* cited by examiner

*Primary Examiner*—George Nguyen
(74) *Attorney, Agent, or Firm*—Mathews, Collins, Shepherd & McKay, P.A.

(57) ABSTRACT

The present invention is directed to a centrifugal barrel finishing machine. The present invention is contemplated to provide the centrifugal barrel finishing machine, which has means for driving each barrel separately from a turret so as to correct a pose of a barrel to be horizontal and thus perform inserting and discharging of work parts effectively, and simultaneously has means for opening and closing a lid of the barrel by a power driven manner using a cylinder or a sliding manner so as to increase convenience and safety with regard to opening and closing of the barrel.

5 Claims, 10 Drawing Sheets

PRIOR ART

PRIOR ART

PRIOR ART

CENTRIFUGAL BARREL FINISHING MACHINE

BACKGROUND OF THE INVENTION

1. Field of the Invention

The present invention relates to a centrifugal barrel finishing machine, more specifically the centrifugal barrel finishing machine, which has means for driving each barrel separately so as to correct a pose of a barrel to be horizontal and thus perform charging and discharging of work parts effectively, and has means for opening and closing a lid of the barrel by a power driven manner using a cylinder or a sliding manner so as to increase convenience and safety with regard to opening and closing of the barrel.

2. Background of the Related Art

Generally, a centrifugal barrel finishing machine is to generate a strong cutting force or to polish/polish work parts, while work parts and media collide with each other by centrifugal force during a rotation of a barrel, after charging media and work parts into the barrel.

FIG. 1–FIG. 3 illustrate the centrifugal barrel finishing machine according to the prior art.

As shown in FIG. 1, the centrifugal barrel finishing machine of the prior art comprises a plurality of barrels 10 which are disposed along a circumferential direction and both ends of their center shafts are coupled by unit bearing so as to rotate by itself, a turret 11 which supports the center shaft of each barrel and rotates in one direction, timing gears 12/timing belts 13 which induce a rotation of the barrel 10 by using the rotating force of the turret 11, a frame 14 which supports both ends of shaft of the turret 11, and motor 15 for driving the turret 11.

A reference numeral 16 indicates idle gears for the tension of the timing belts and a reference numeral 17 indicates a center gear, which is fixed to a turret shaft and serves as a center member for power transmission of each timing belt.

Therefore, when the turret 21 rotates by the operation of the motor 15, the timing belts 13 connected to the timing gears 12 of each barrel 10 proceed in one direction while the timing belts rotate together and teeth thereof are engaged with the fixed center gear 17, and the barrel 10*s* are rotated by itself in an opposite direction with regard to the turret 11 so that work parts in the barrels could be grinded or polished As shown in FIG. 2, the barrel 10 is a can-shaped weighted object having the stiffness against a collision of media and work parts therein, both ends of a center shaft is supported in the turret 11 to enable the barrels to rotate, and a lid 19 of the barrel 10 maintains locking status by a locking device the both ends thereof being supported to holder 18 which is attached to a barrel body.

The locking device of the lid 19 includes eccentric pins 21 that are inserted movably into cylindrical guides 20*a* welded on both sides in an upper surface of the lid 19 and simultaneously are inserted into grooves 18*a* formed at upper ends of holders 18, levers 22 connected to the eccentric pins 21 for handling, fixing pins 23 which are inserted into holes 22*a* of the levers 22 so as to maintain the locking position of the levers 22, and guides 20*b* for fixing pins 23. As shown in FIG. 3, when levers 22 are pulled upwardly with releasing of fixing pins 23 and then eccentric pins 21 are pulled out of grooves 18*a*, the lid 19 could be released.

A reference numeral 24 not described indicates adjustment bolts for adjusting the locking force of eccentric pin 21 which are inserted and locked up in holes 18*a* of holders 18.

However, such centrifugal barrel finishing machine of the prior art has various disadvantages as below.

1) When the turret is stopped with stopping of the motor after polishing, the pose of the barrel is inclined instead of being horizontal, or sometimes inverted, so that there is inconvenience in taking work parts out of the barrel or inserting work parts into the barrel again. In addition, although user may stop the finishing machine with maintaining the pose of barrel to be horizontal, this could be cumbersome.

2) Also, as mentioned above, since the lid of the barrel is considerably heavy, the user usually has a trouble in lifting the lid using a handle attached thereto, and occasionally may drop the lid. Therefore, the centrifugal barrel finishing machine of the prior art is unsatisfactory in aspect of the convenience and safety of the user.

SUMMARY OF THE INVENTION

The present invention is contemplated to solve the aforementioned problem, and it is an object of the present invention to provide a centrifugal barrel finishing machine, which has means for driving each barrel separately so as to correct a pose of a barrel to be horizontal and thus perform charging and discharging of work parts effectively.

It is another object of the present invention to provide a centrifugal barrel finishing machine which has means for opening and closing a lid of the barrel by a power driven manner using a cylinder or a sliding manner so as to increase convenience and safety with regard to opening and closing of the barrel.

To accomplish the above object, the present invention provide a centrifugal barrel finishing machine comprising: a plurality of barrels having lids which is able to be opened and closed through an operation of a locking device, the barrels being disposed along a circumferential direction and the both ends of their center shafts are coupled by unit bearing so as to rotate by itself; a turret for supporting the center shaft of each barrel and rotating in one direction; timing gears and a timing belts for inducing a rotation of the barrels by using rotating force of the turret; a frame for supporting both ends of a shaft of the turret; a motor for driving the turret; an idle gear for tension of the timing belts; a center gear being mounted to the turret shaft and serves as a center member for a power transmission of each timing belt; and a device for driving each barrel separately from the turret including; an auxiliary center gear being mounted integrally with the center gear, an auxiliary reduction motor being installed to a lower part of the frame and proving the power to the auxiliary center gear, a driving gear being mounted to a shaft of the auxiliary reduction gear, an auxiliary timing belt for transmitting the power between the auxiliary center gear and the driving gear, and an auxiliary idle gear for adjusting a tension of the auxiliary timing belt.

Preferably, the lid is opened and closed by a power driven type opening/closing device or a slide type opening/closing device.

More specifically, the power driven type opening/closing device includes; a cylinder being hinged vertically in the rear of the barrel, at least three leads being mounted in the rear of an upper surface of the lid, one of the leads being connected to the cylinder, a hinge shaft penetrating through the leads, hinge brackets being fixed to a rear surface of the barrel and supporting both ends of the hinge shaft, and a shock absorber being installed to connect between the barrel and lid and assisting the lid in opening and closing.

Additionally the slide type opening/closing device includes; lid guide bars being mounted vertically at both side of a rear surface of the barrel and having sliding grooves along an entire length thereof, a part of the lid guide bar extending horizontally over an upper surface of the lid, and guide pins being formed to be projected and formed integrally with both sides of the lid, the guide pins being inserted into the sliding grooves so as to slide therein.

It is featured that magnets attachable to lid guide bars are installed at positions in both side surfaces of the lids, at a certain distance from the guide pin.

BRIEF DESCRIPTION OF THE DRAWINGS

The features and advantages of the present invention will be more described specifically in the following description of preferred embodiments of the invention with reference to the accompanying drawings wherein.

DETAILED DESCRIPTION OF THE PREFERRED EMBODIMENT

Figure 1:
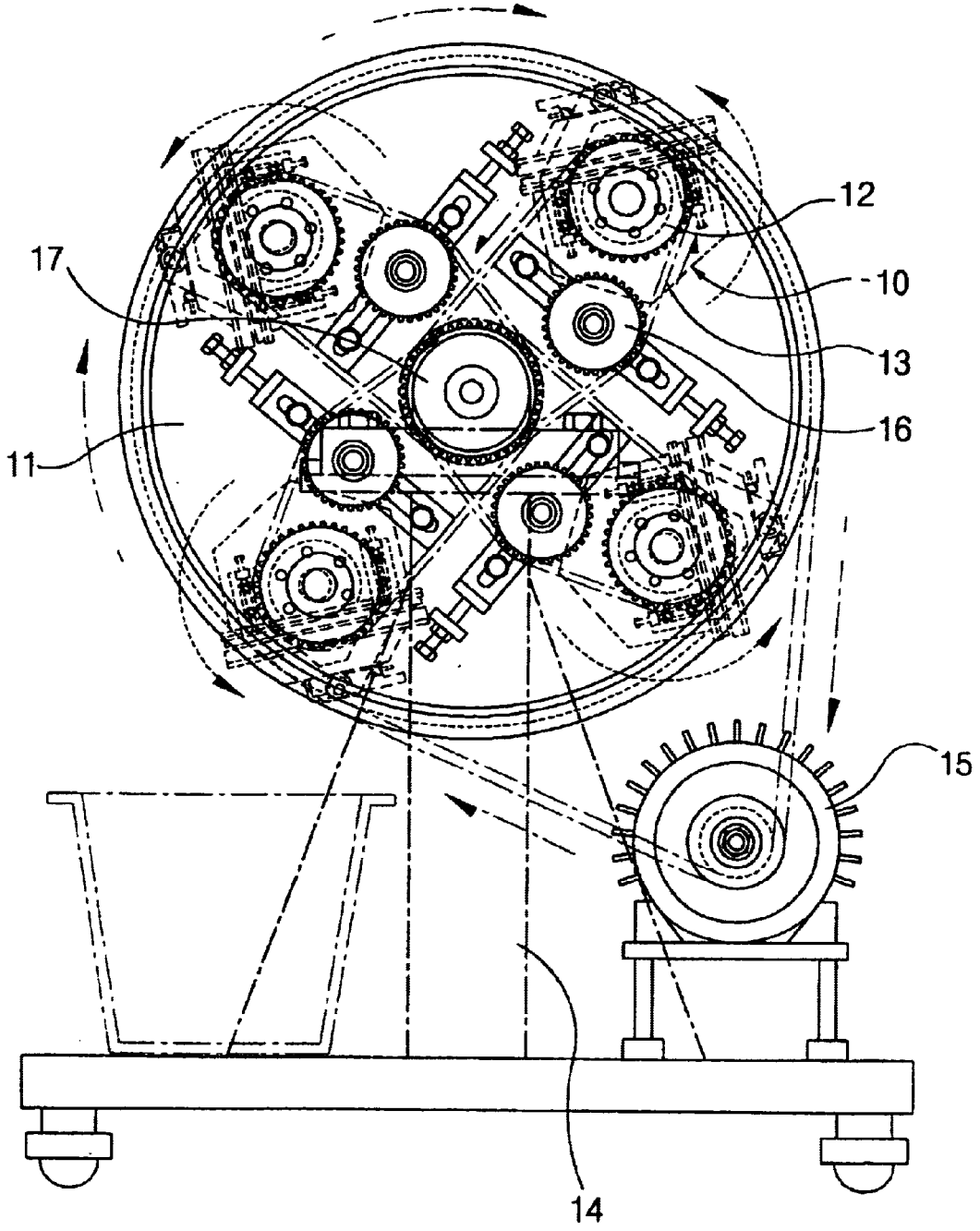
FIG. 1 is a front view showing a centrifugal barrel finishing machine according to the prior art.
Figure 2:
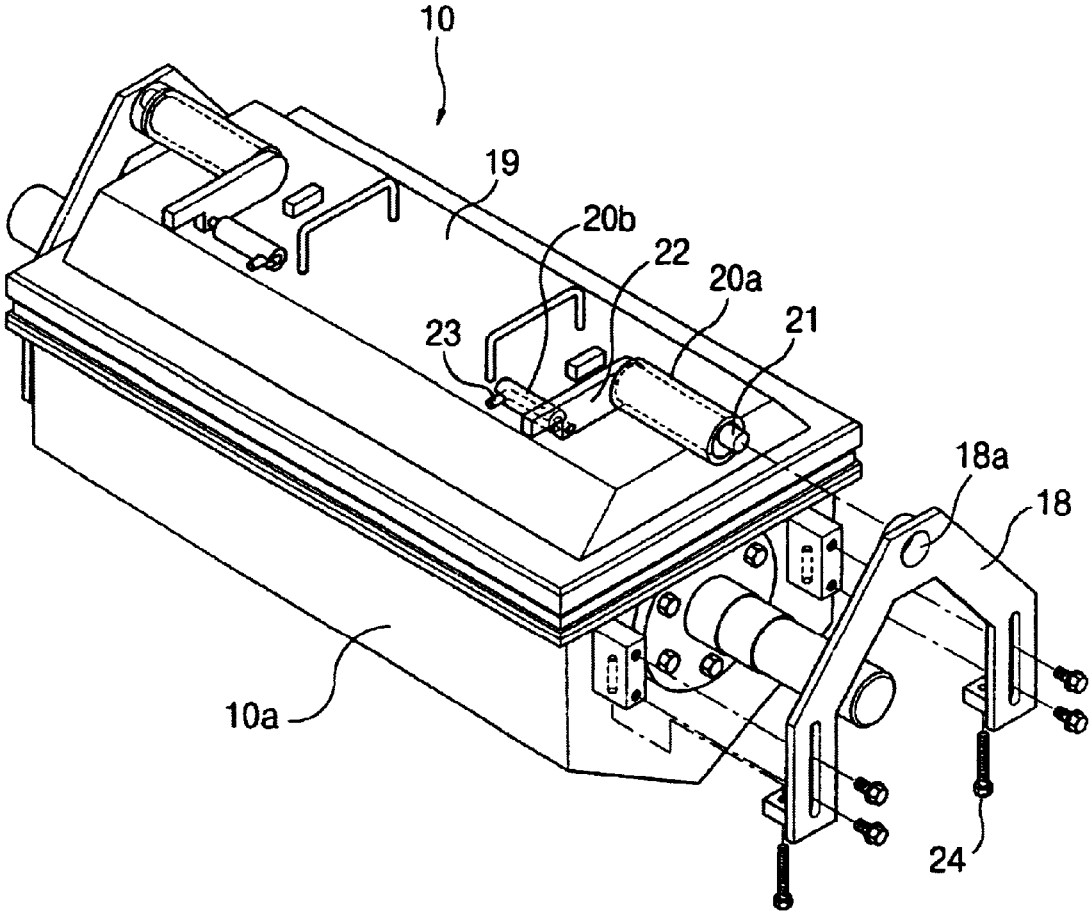
FIG. 2 is a partially separated perspective view showing a barrel of a centrifugal barrel finishing machine according to the prior art.
Figure 3:
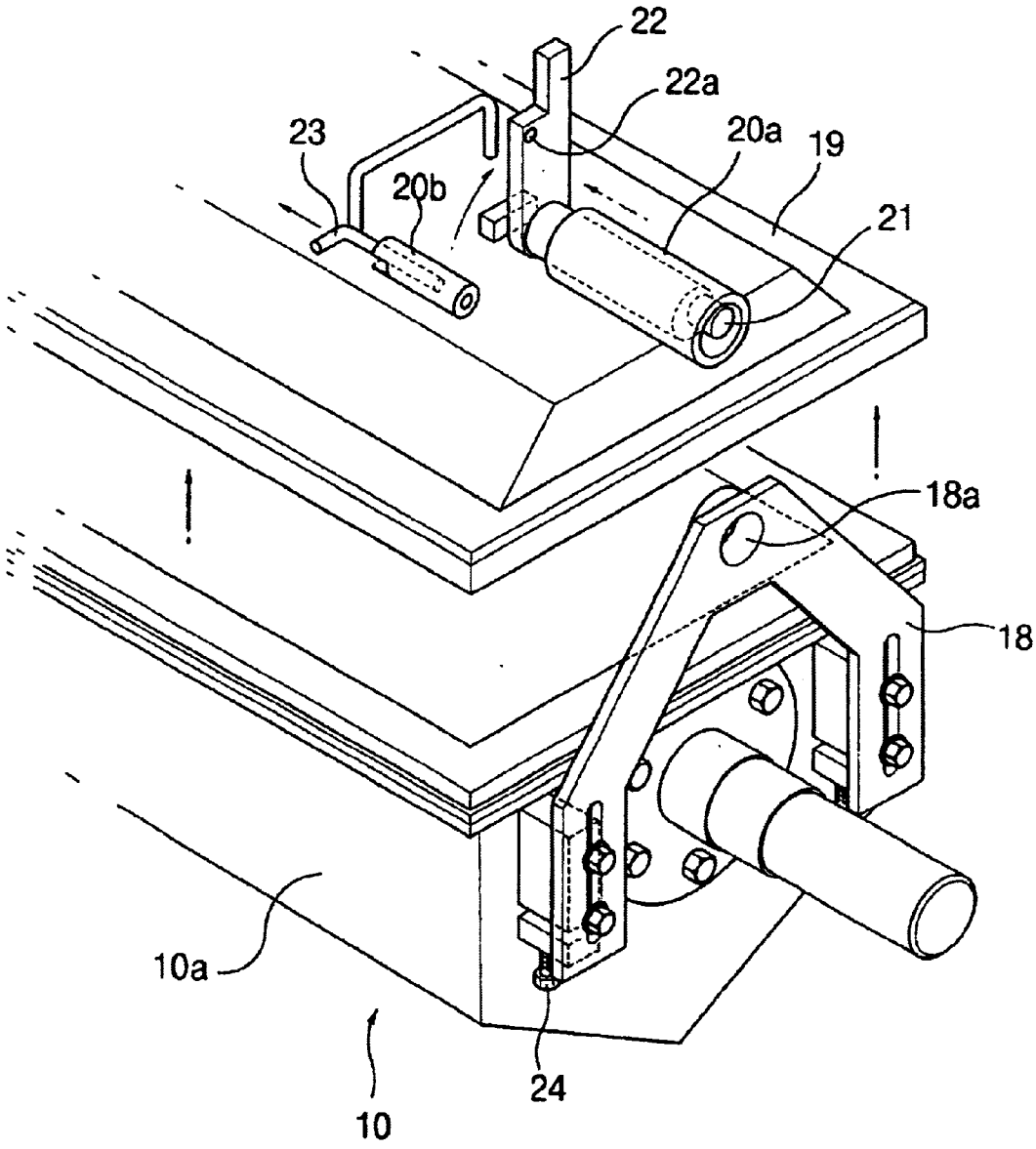
FIG. 3 is a perspective view showing a status, which a lid is opened in a centrifugal barrel finishing machine according to the prior art.

Reference will now be made in detail to the first and second embodiment of the present invention, examples of which are illustrated in the accompanying drawings. In explaining the present invention, the same names and reference numerals will be given to the same components, and explanations in the same will be omitted.

Figure 4:
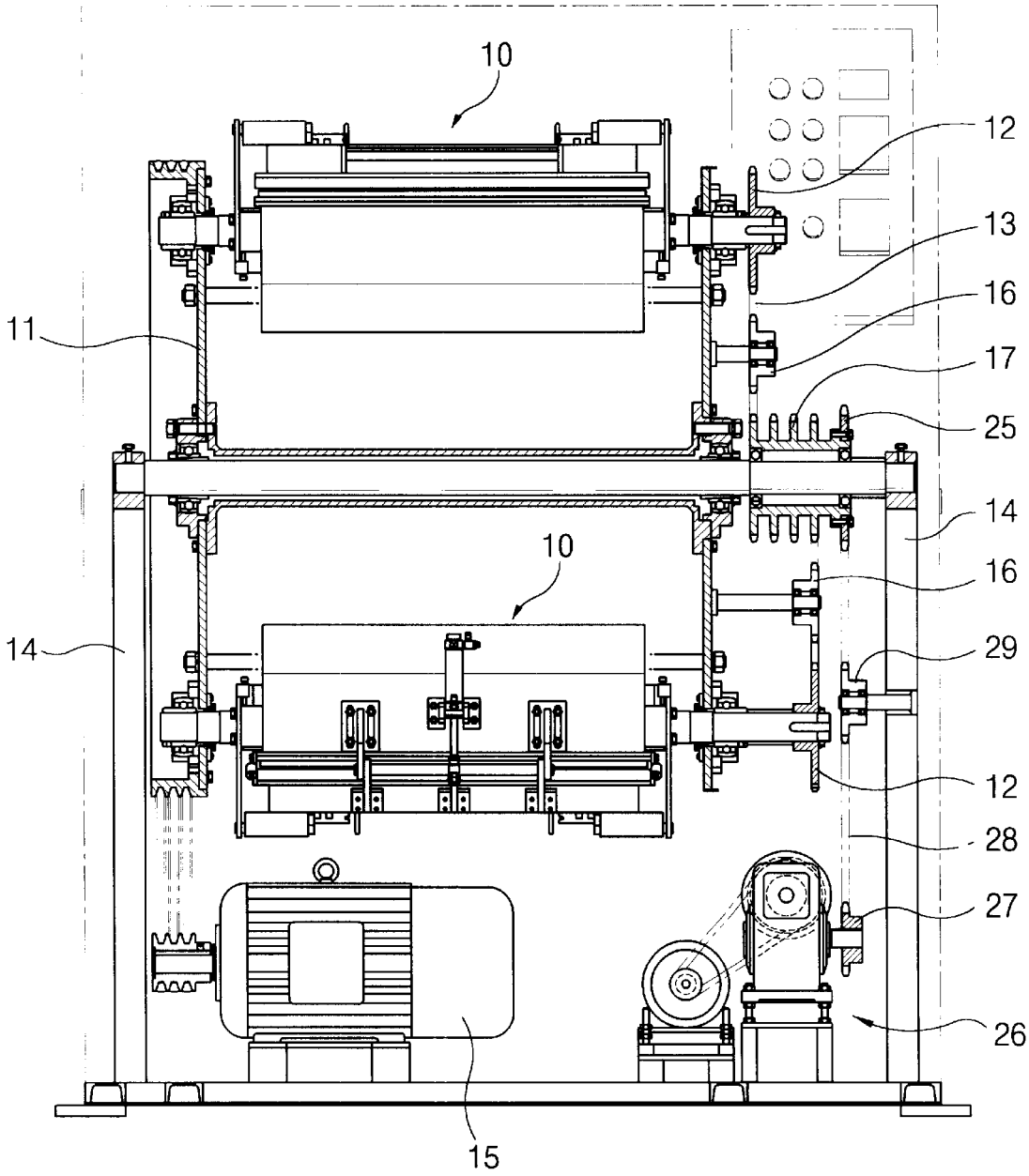
FIG. 4 is a front view showing a centrifugal barrel finishing machine according to the present invention.
Figure 5:
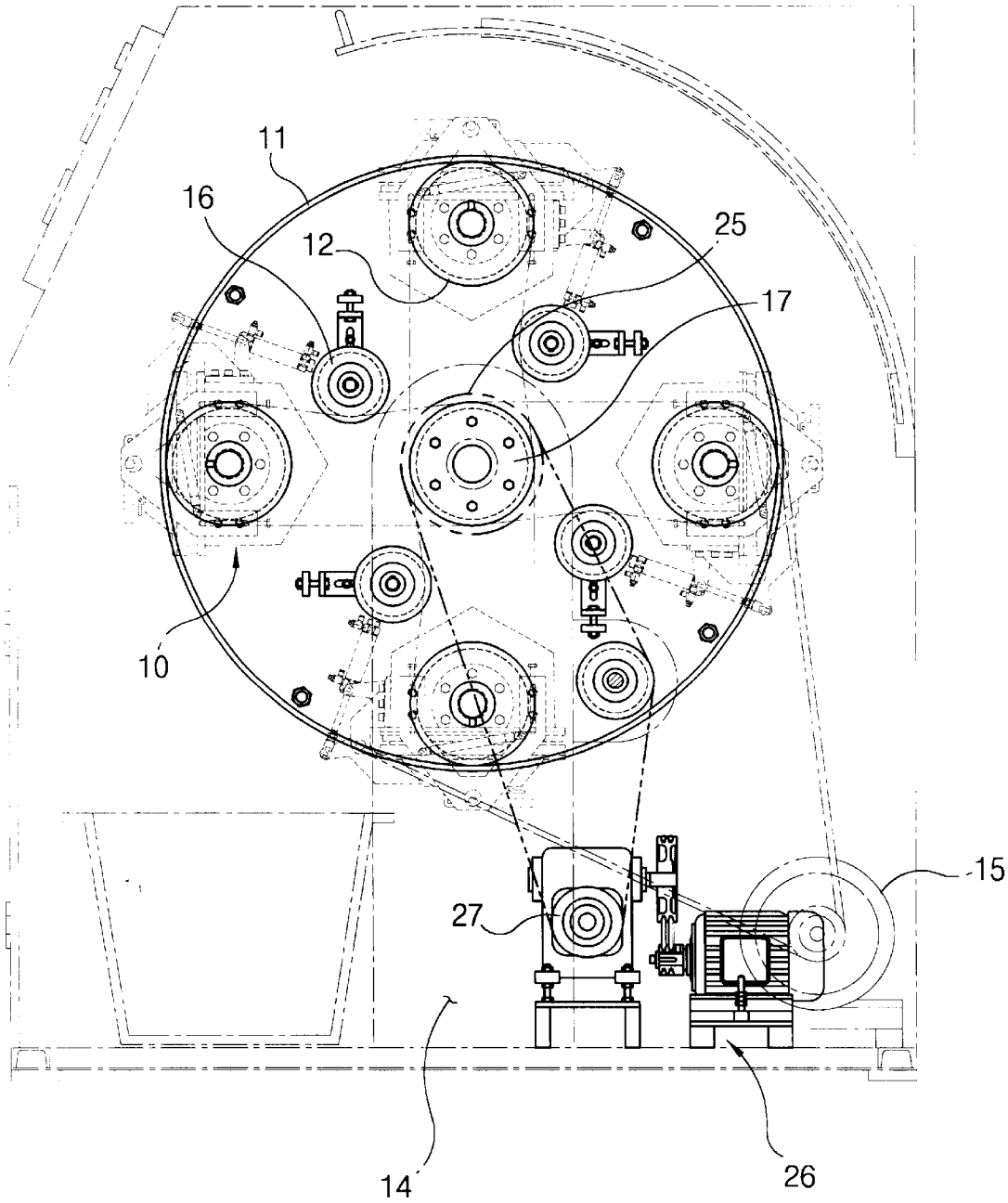
FIG. 5 is a side view showing a centrifugal barrel finishing machine according to the present invention.

A centrifugal barrel finishing machine of the present invention, as shown in FIG. 4 and FIG. 5, includes at least four barrels 10 which are disposed along a circumferential direction of a turret 11 with rotating by itself and receive media and work parts therein, the turret 11 which is connected to a motor 15 by a belt and the like and rotates in one direction together with each barrel 10, timing gears 12/timing belts 13 which are intermediated members for gearing by itself using the rotating force of the turret 11 and rotating the barrels 10, a plurality of idle gears 16 which maintain the tension of the timing belt 13, and a frame 14 which supports various elements set forth above. When the turret 11 rotates by the operation of the motor 15, the timing belts 13 connected to the timing gears 12 of each barrel 10 rotate together with the turret 11 and proceed in one direction while teeth of the timing belts are engaged serially with the fixed center gear 17 by being associated with an auxiliary motor 26 and auxiliary center gear 25 described later, and thus the barrels 10 are rotated by itself in an opposite direction with regard to the turret 11 by the centrifugal force.

In this manner, the centrifugal barrel finishing machine could polish or grind work parts in the barrels 10 by using the rotation of the turret 11 and the self rotation of the barrels 10.

Additionally, both ends of the barrel 10 are supported rotatably in the turret 11 by using a center shaft formed at the center of gravity of the barrels 10, and a lid 19 of the barrel 10 is locked by a locking device which is configured to be supported at both ends thereof by holders 18 attached to a body 10*a*.

The locking device may be the same device applied to the centrifugal barrel finishing device of the prior art.

Especially, the present invention could make it easy to charge or discharge media and work parts into or from the barrels 10 by providing an additional barrel rotating device.

For this, as shown in FIG. 5, the auxiliary center gear 25 that could operate together with the center gear 17 is mounted at the center gear 17 mounted to a center shaft of the turret 11.

The auxiliary center gear 25 mounted like this is disposed parallel to each timing gear 12 which is belong to the center gear 17 and is rotated selectively with the center gear 17.

Also, the center gear 17 including the auxiliary center gear 25 is mounted to the center shaft of the turret 11 with an interposed bearing, so that it could rotate as needed.

An auxiliary reduction motor 26 is provided as means for driving the auxiliary center gear 25 and center gear 17.

The auxiliary reduction motor 26 is installed on the frame 14 below the auxiliary center gear 25 and center gear 17.

A driving gear 27 is mounted to a shaft of the auxiliary reduction motor 26 and the driving gear 27 is connected to the auxiliary center gear 25 by an auxiliary timing belt 28, so that the auxiliary center gear 25 and center gear 17 could rotate according to the operation of the auxiliary motor 26.

An auxiliary idle gear 29 is installed on the frame at predetermined position of the auxiliary timing belt 28, in order to maintain the tension of the auxiliary timing belt 28.

Thus, the auxiliary center gear 25 and center gear 17 are able to rotate only when the auxiliary reduction motor 26 operates, and are unable to rotate due to the interference with the driving gear 27 through the auxiliary timing belt 28 when the auxiliary reduction motor 26 stops.

Accordingly, When the turret 11 rotates by the operation of the motor 15, the timing belt 13 connected to the timing gear 12 of each barrel 10 rotates together with the turret 11 since teeth of the timing belt are engaged serially with the fixed center gear 17, and at the same time rotates the barrel 10 in an opposite direction with regard to the turret 11 direction.

At this moment, since the driving gear 27 fixed by stopping of the auxiliary reduction motor 26 holds the auxiliary center gear 25 through the auxiliary timing belt 28, the center gear 25 could maintain the fixed status, and thereby the self rotation of the barrel 10 according to the rotation of the turret 11 is achieved naturally.

Figure 6:
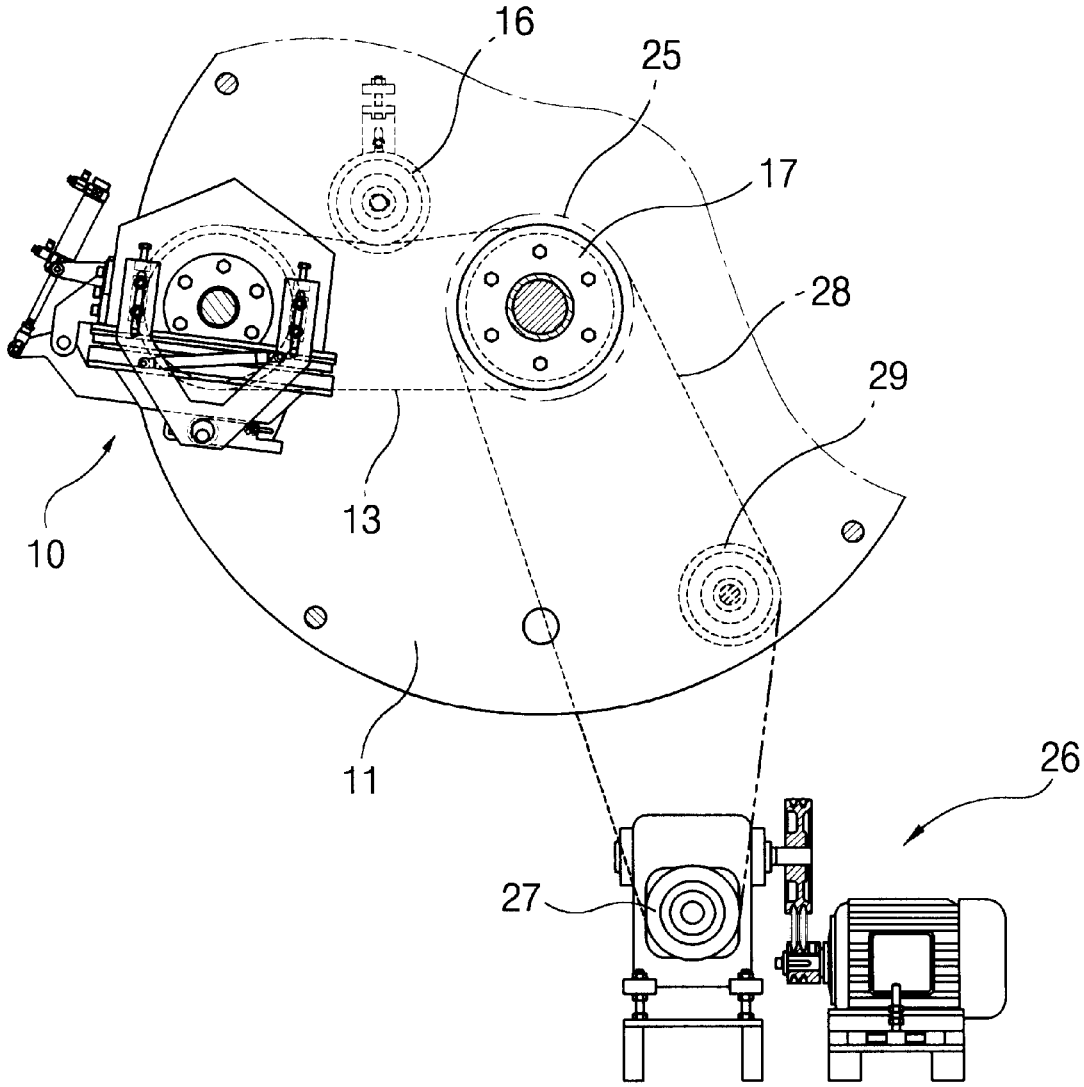
FIG. 6 and FIG. 7 are front views showing status, which a pose of barrel is corrected in a centrifugal barrel finishing machine of the present invention.

After the polishing, the motor 15 is stopped in order to take the work parts out of the barrel 10, the turret 11 and barrel 10 are stopped together. As shown in FIG. 6, if one of the four barrels 10 has a pose unsuitable to taking out work parts, the pose of the barrel 10 is corrected by operating the auxiliary reduction motor 26.

Figure 7:
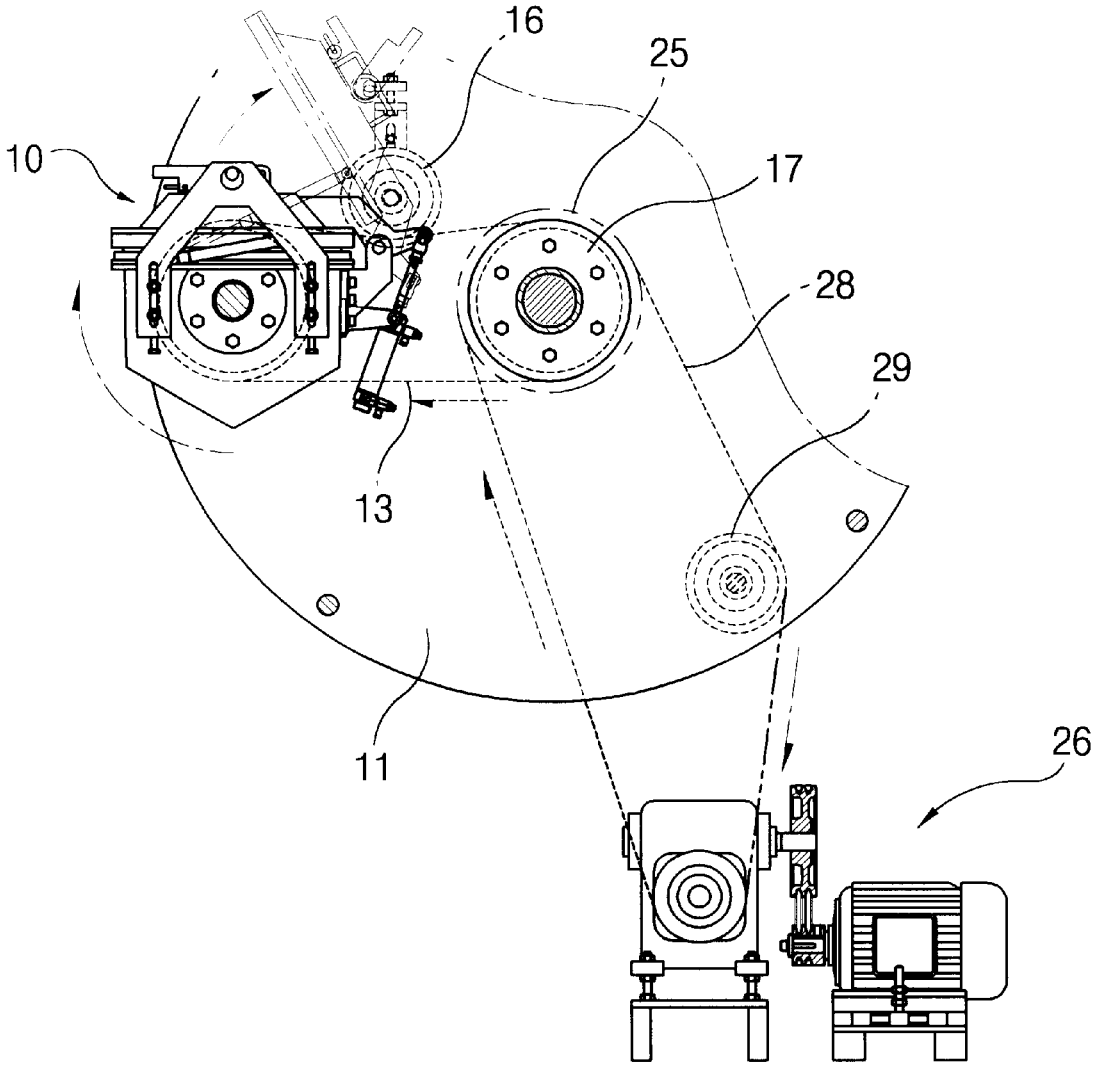

That is, as shown in FIG. 7, when the auxiliary reduction motor 26 is operated, the auxiliary center gear 25 and center gear 17 rotate by the power transmitted through the auxiliary timing belt 28 and thus only each barrel 10 is able to rotate. Therefore, when the pose of the barrel 10 in position for taking out work parts becomes horizontal correctly, the operation of the auxiliary motor 26 is stopped and then polished work parts could be taken out of the barrel 10.

Meanwhile, the present invention provides an opening/closing device which is able to open and close the lid 19 of the barrel 10 by a power driven manner using a cylinder or a sliding manner so that user could open and close the heavy lid easily and the danger of accident is also prevented.

Figure 8:
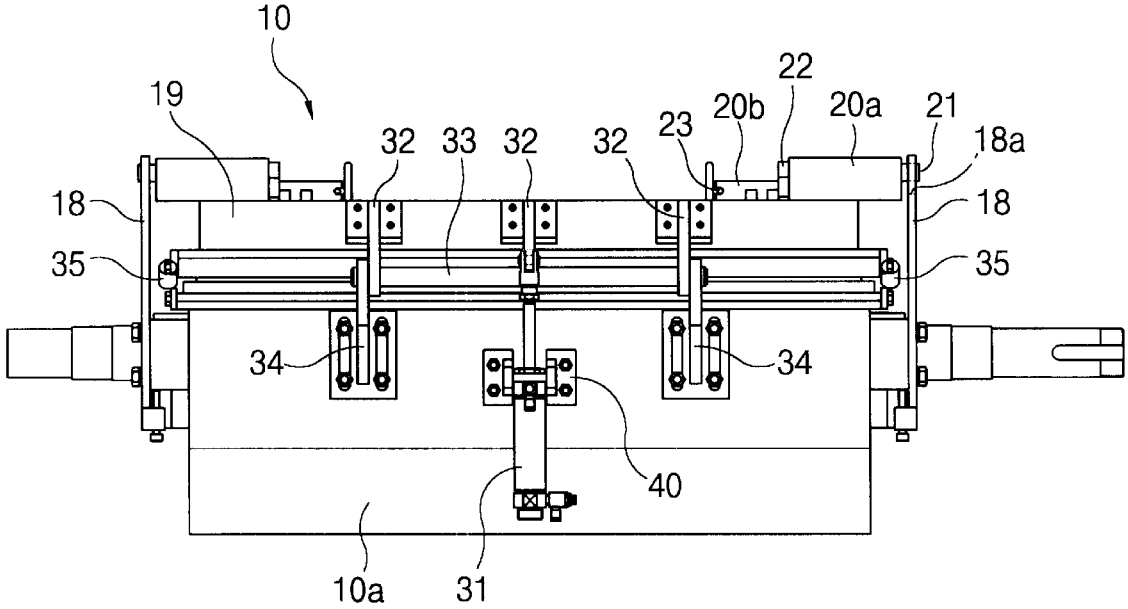
FIG. 8 is a front view showing an embodiment of barrel in a centrifugal barrel finishing machine of the present invention.
Figure 9:
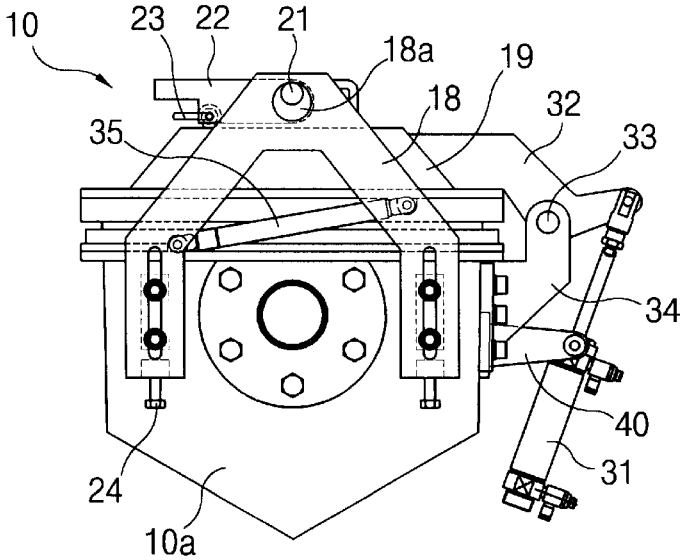
FIG. 9 is a side view of FIG. 8.

As shown in FIG. 8 and FIG. 9, in a power driven type opening/closing device as one embodiment of the lid opening and closing device, a vertical cylinder(substantially pneumatic cylinder) 31 is hinged on a cylinder bracket 40 in the rear of the barrel 10, at least three leads 32 and a hinge shaft 33 penetrating though the leads 32 are mounted in the rear of an upper surface of the lid 19 and a center lead 32 is connected to the cylinder 31, and hinge brackets 34 are installed on both ends of a rear surface of the barrel body so as to support both ends of the hinge shaft 33 rotatably.

Figure 10:
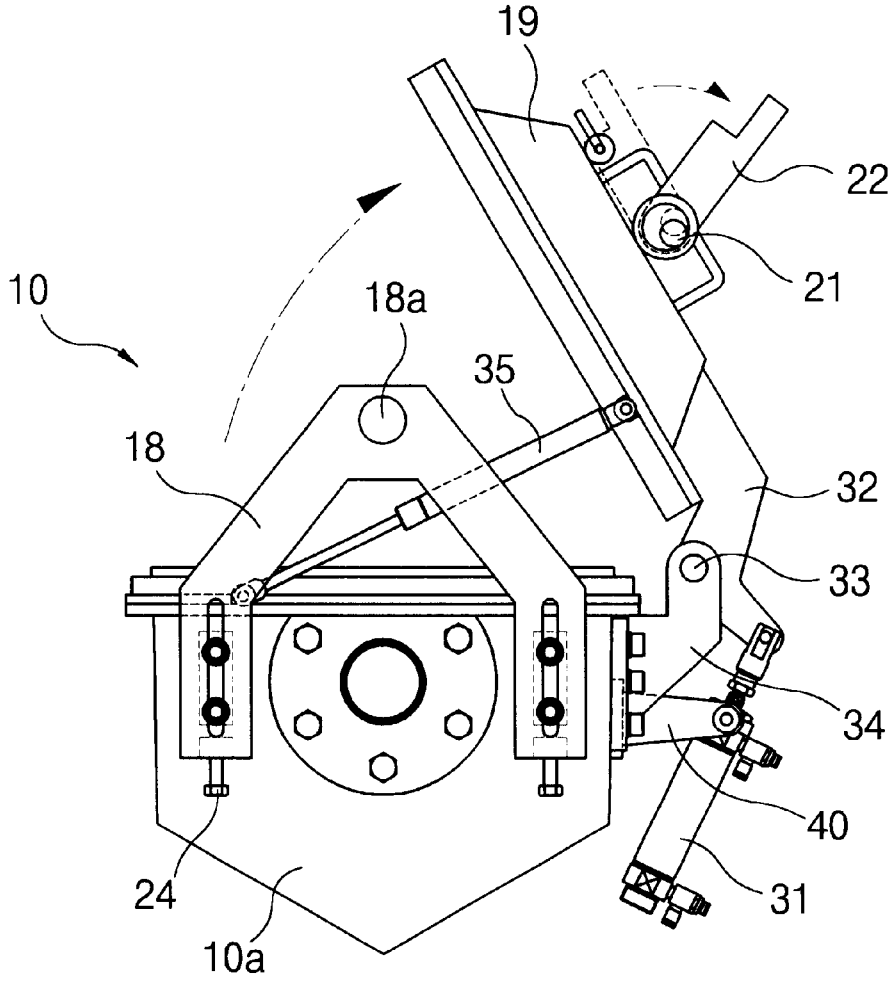
FIG. 10 is a side view showing a status, when the lid is opened in FIG. 9.

Accordingly, as shown in FIG. 10, the lid 19 is opened and closed, by rotating the hinge shaft 33 as a pivot supported by the hinge bracket 34.

Especially, a shock absorber 35 is installed at both sides to connect between the barrel 10 and lid 19, so that a sudden opening or closing of the lid 19 could be prevented.

Figure 11:
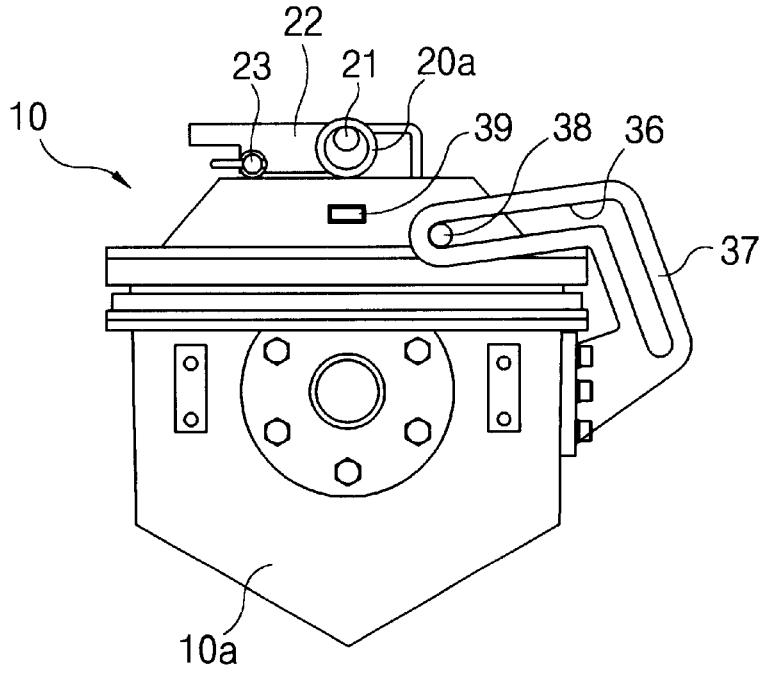
FIG. 11 is a side view showing another embodiment of barrel in a centrifugal barrel finishing machine of the present invention.
Figure 12:
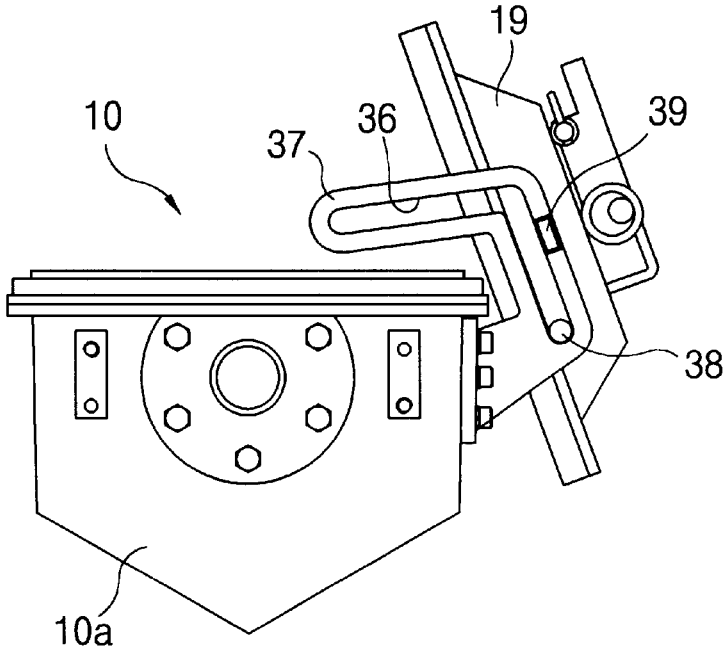
FIG. 12 is a side view showing the opened status of FIG. 9.

As shown in FIG. 11 and FIG. 12, in a slide type opening/closing device as another embodiment of the lid opening and closing device, lid guide bars 37 having sliding grooves 36 are mounted vertically at both side of the rear surface of the barrel 10, and the lid 19 is inserted into the guide bars 37 by using guide pins 38 formed integrally with both sides of the lid so as to be supported to slide therein.

Since the lid guide bars 37 have a length extending from the rear surface of the barrel 10 to a part of the upper surface of the lid 19, it allows the easy opening and closing by sliding. Especially, the sliding groove 36 includes a horizontal portion permitting the lid 19 to be pulled backwardly and an almost vertically inclined portion maintaining the lid 19 to be pulled back completely, so that the convenience and safety in opening and closing the lid 19 are guaranteed.

Additionally, magnets 39 are installed at positions on both side of lid at a predetermined distance from the guide pins 38, and when the lid 19 is opened and pulled back completely, the magnets 39 is attached to the lid guide bar 37 so that the closing of the lid 19 is prevented.

Since this slide type opening and closing device is operated directly by the user, it is somewhat inconvenient compared with the power driven type device. However, since the lid 19 is opened and closed moving along the guide bar 37, the slide type opening and closing device is more convenient and safer than conventional device.

The advantages of the present invention are summarized as follows.

The present invention provides the centrifugal barrel finishing machine, which includes means for driving each barrel separately from the turret and means for opening and closing the lid of the barrel by the power driven manner using the cylinder or the sliding manner, so that the pose of the barrel could be corrected to be horizontal and thus perform charging and discharging of work parts effectively, and the convenience and safety with regard to opening and closing of the barrel are increased.

Although a number of embodiment have described in the above specification, it should be apparent that the present invention could be embodied in many other specific mode included within the spirit and scope of the present invention. Thus, the present embodiments should be considered as illustrative, and the present invention could be modified within the scope of claims and the equivalent thereof.

That is, in the above embodiments, although the centrifugal barrel finishing machine in which the barrel is driven by the timing belt is described, this timing belt could be substituted by a chain.

What is claimed is:

1. A centrifugal barrel finishing machine comprising:

a plurality of barrels having lids which is able to be opened and closed through an operation of a locking device, the barrels being disposed along a circumferential direction and the both ends of their center shafts being coupled by unit bearing so as to rotate by itself;

a turret for supporting the center shaft of each barrel and rotating in one direction;

timing gears and a timing belts for inducing a rotation of the barrels by using rotating force of the turret;

a frame for supporting both ends of a shaft of the turret;

a motor for driving the turret;

idle gears for tension of the timing belts;

a center gear being mounted to the turret shaft and serves as a center member for a power transmission of each timing belt; and a device for driving each barrel separately from the turret including;

an auxiliary center gear being mounted integrally with the center gear, an auxiliary reduction motor being installed to a lower part of the frame and proving power to the auxiliary center gear, a driving gear being mounted to a shaft of the auxiliary reduction gear, an auxiliary timing belt for transmitting the power between the auxiliary center gear and the driving gear, and an auxiliary idle gear for adjusting a tension of the auxiliary timing belt.

2. The machine according to claim 1, wherein the lid is opened and closed by a power driven type opening/closing device or a slide type opening/closing device.

3. The machine according to claim 2, wherein the power driven type opening/closing device includes;

a cylinder being hinged vertically in the rear of the barrel, at least three leads being mounted in the rear of an upper surface of the lid, one of the leads being connected to the cylinder, a hinge shaft penetrating though the leads, hinge brackets being fixed to a rear surface of the barrel and supporting both ends of the hinge shaft, and a shock absorber being installed to connect between the barrel and lid and assisting the lid in opening and closing.

4. The machine according to claim 2, wherein the slide type opening/closing device includes;

lid guide bars being mounted vertically at both side of a rear surface of the barrel and having sliding grooves along an entire length thereof, a part of the lid guide bar extending horizontally over an upper surface of the lid, and guide pins being formed to be projected and formed integrally with both sides of the lid, the guide pins being inserted into the sliding grooves so as to slide therein.

5. The machine according to claim 4, wherein magnets attachable to lid guide bars are installed at positions in both side surfaces of the lids, which space apart from the guide pins with a predetermined distance.

* * * * *